US005392728A

United States Patent [19]

Speer et al.

[11] Patent Number: 5,392,728

[45] Date of Patent: Feb. 28, 1995

[54] ROADWAY MARKERS WITH CONCAVE CURVED EDGES

[75] Inventors: Peter A. Speer, Kirkland; Michael W. Sly, Kent; Harry J. Glutting, Tacoma, all of Wash.

[73] Assignee: Davidson Plastic Company, Kent, Wash.

[21] Appl. No.: 92,708

[22] Filed: Jul. 15, 1993

Related U.S. Application Data

[63] Continuation-in-part of Ser. No. 735,321, Jul. 24, 1991, Pat. No. 5,327,850, which is a continuation-in-part of Ser. No. 694,873, May 2, 1991, abandoned.

[51] Int. Cl.[6] ..... E01F 9/06

[52] U.S. Cl. ..... 116/63 R; 404/16

[58] Field of Search ..... 116/63 R, 63 P, DIG. 16; 404/9, 12, 14, 15, 16

[56] References Cited

U.S. PATENT DOCUMENTS

| | | | |
|---|---|---|---|
| 1,707,432 | 4/1929 | Erickson . | |
| 1,966,678 | 7/1934 | Osbrink | 404/15 X |
| 2,664,065 | 12/1953 | Thompson | 116/63 |
| 3,277,800 | 10/1966 | Wiswell | 94/1.5 |
| 3,319,542 | 5/1967 | Bergsnov-Hansen | 94/1.5 |
| 3,332,327 | 7/1967 | Heenan | 94/1.5 |
| 3,485,148 | 12/1969 | Heenan | 404/16 X |
| 3,588,222 | 6/1971 | Julius | 350/100 |
| 3,924,958 | 12/1975 | Rowland | 404/15 |
| 3,936,208 | 2/1976 | Baynes et al. | 404/16 |
| 3,938,903 | 2/1976 | Montgomery | 404/16 |
| 4,234,265 | 11/1980 | Otis | 404/16 |
| 4,340,319 | 7/1982 | Johnson, Jr. et al. | 404/16 |
| 4,428,320 | 1/1984 | Oplt et al. | 116/63 R |
| 4,498,733 | 2/1985 | Flanagan | 404/14 X |
| 4,521,129 | 6/1985 | Krech et al. | 404/10 |
| 4,557,624 | 12/1985 | Walker | 404/14 |
| 4,588,258 | 5/1986 | Hoopman | 350/103 |
| 4,618,281 | 10/1986 | Ajemian | 116/63 R X |
| 4,717,281 | 1/1988 | Shepherd et al. | 404/16 |
| 4,726,706 | 2/1988 | Attar | 404/14 |
| 4,875,798 | 10/1989 | May | 404/12 |
| 5,226,745 | 7/1993 | Gartlacher | 404/14 |

FOREIGN PATENT DOCUMENTS

| | | | |
|---|---|---|---|
| 2020221 | 11/1971 | Germany | 404/16 |

*Primary Examiner*—William A. Cuchlinski, Jr.
*Assistant Examiner*—John L. Beres
*Attorney, Agent, or Firm*—Christensen, O'Connor, Johnson & Kindness

[57] ABSTRACT

Roadway markers (11) with large rectangularly shaped bases and a raised rumble portion containing at least one concave curved edge (21, 23) are disclosed. The concave curved edges (21, 23) face oncoming traffic. The concavity may have a constant radius of curvature or may decrease with increased elevation. The height-to-width ratio of the roadway marker and the average radius of curvature are such that automobile tires (41) impacting the roadway marker (11) do not impact the surface of the concavity. Rather, tires (41 ) impacting the roadway marker ( 11 ) hit the marker above the edge concavity. As a result, a gap exists between impacting tires and the surface of the concavity. Water squeezed from a wet tire impacting the roadway marker will enter the gap and wash the surface of the concavity. A reflective tape (31) is attached to the surface of the concavity. In some embodiments of the invention concavities are located in opposite edges of the raised rumble portion. In other embodiments, a single concavity is located along only one edge of the raised rumble portion. In the two-edge versions of the invention, preferably, a recess (19) is located between the parallel concave curved edges.

26 Claims, 9 Drawing Sheets

ROADWAY MARKERS WITH CONCAVE CURVED EDGES

CROSS-REFERENCE TO RELATED APPLICATIONS

This application is a continuation-in-part of U.S. patent application Ser. No. 07/735,321, filed Jul. 24, 1991, now U.S. Pat. No. 5,327,850, issued Jul. 12, 1994, and entitled ROADWAY MARKER, which is a continuation-in-part of U.S. patent application Serial No. 07/694,873, filed May 2, 1991, also entitled ROADWAY MARKER, now abandoned.

TECHNICAL AREA

This invention relates to roadway markers and, more particularly, to low profile, lightweight roadway markers.

BACKGROUND OF THE INVENTION

Roadway markers are utilized in a variety of traffic control situations. Many roadway markers are affixed to a roadway to permanently delineate lanes of traffic on the roadway. Other roadway markers are used to temporarily delineate construction or work areas. Both permanent and temporary roadway markers are attached to a roadway with a suitable adhesive.

Permanent roadway markers have a low profile and remain in place to permanently define traffic lanes, identify obstacles, and perform other well-known functions, such as providing daytime visibility, and night time reflectivity, especially on wet nights when flush pavement markers disappear under a film of water. While having a low profile, many permanent roadway markers are raised to create a rumble sound in an automobile when the tires of the automobile impact a row of markers. The most commonly used permanent marker is formed of ceramic and has a partially hemispherical, button-like shape. In recent years, alternative roadway markers having inclined surfaces covered with a retroreflective medium in the form of a surface tape or embedded prisms have been developed for use as permanent roadway markers.

Many firms currently market roadway markers similar to that illustrated in U.S. Pat. No. 3,332,327. One example of such a product is the Model 88 sold by Stimsonite Corporation. Similar products are sold by Ray-o-lite Div. of Pac-Tech, Pavement Markers, Inc., and Apex International. The shells of these markers are variously transparent or opaque and have the form of a truncated pyramid. One or two lenses are either insert molded or molded integrally into the sides of these markers. The lenses are made retroreflective by including large cube-corner patterns on the inside of the sloped faces. After coating these inner faces with a light-reflecting material, e.g., aluminum, the plastic shell is filled with a relatively rigid material such as epoxy resin and the bottom surface covered with sand or glass beads to enhance the adhesion of the marker to the roadway.

Other roadway markers, essentially the same as those aforementioned in many ways, but differing in either shape or lens construction, are also currently available. The Stimsonite Model 948 is more elongated and lower in profile, but narrower in width. The Ray-o-lite Model 2001 has a similar shape. The markers of the type discussed in U.S. Pat. No. 4,726,706, such as the Stimsonite 953, differ in lens construction. Their lenses are "air-gap" reflectors rather than metallized like previous markers. The marker described in U.S. Pat. No. 4,875,798 is roughly the same shape as the Stimsonite Model 948, but is not filled and utilizes a reflective sheeting rather than an integrally molded reflective lens.

As is pointed out in many of the foregoing patents, the outer face of prior markers are sloped from the roadway at an angle large enough for good reflectivity and small enough to allow a wiping action by vehicle tires, i.e., from 15° to 45° and preferably 30° to the surface of the road. The reflective materials used are either methyl methacrylate or polycarbonate. Both of these materials exhibit good optical qualities but are either extremely brittle, abrade very easily, or both. To overcome the problems associated with these characteristics, the Stimsonite Model 948 bonds a thin veneer of untempered glass to the outside face of the reflector. See U.S. Pat. No. 4,340,319. Ray-o-lite reportedly uses a chemical treatment that purports to do the same. Both of these solutions to the brittleness and abrasive problem are, from a manufacturing point of view, expensive. Further, they are unsatisfactory. In the case of the Stimsonite Model 948, the glass is very thin and still abrades quite readily. The Ray-o-lite product, while abrasion resistant, turns dark when installed on the road, thus rendering the marker substantially ineffective.

The marker described in U.S. Pat. No. 4,875,798 utilizes a very thin (2 mm) reflective sheeting for its reflective lens. The lens as disclosed lies at an angle from 15° to 45° to the roadway. This exposes the face of the lens to a tremendous amount of abuse by vehicle tires. After a short amount of time the reflectors of these markers become abraded, and begin to peel off of the marker body, thus reducing their effectiveness.

The sheeting described in U.S. Pat. No. 4,588,258 (Hoopman) incorporated into the marker described in U.S. Pat. No. 4,875,798 (May) is made of a rigid thermoplastic such as polycarbonate, as noted in the May patent. While these patents do not disclose whether the sheeting is or is not metallized, markers incorporating this technology have been produced both with and without metallization. Both types are initially quite bright, as predicted in the patent. However, over a long period of time, the reflectors fail due to the forces described above.

As noted above, abrasion is one of the major problems faced by roadway markers, particularly permanent roadway markers. Abrasion becomes particularly acute when pavement markers are used in areas where abrasive materials, such as sand and salt, are distributed over the roadway surface during the winter months. The sand and salt are continuously brought into contact with the reflectors of the pavement markers of the type described above by the wiping action of the tires. The combination of the abrasive materials and the wiping action of the tires tends to scratch the surface of the reflective lenses of such markers, rapidly diminishing their optical effectiveness and reflective quality.

High speed photography has revealed that the area of a typical marker that receives the most abuse is the "shoulder" of the marker, where the planes of the reflector face and the top of the marker join. At the initial impact, a tire rests on the pavement just in front of the marker and on the shoulder of the marker. Contrary to what is stated in a number of patents, the tires never "wipe" the face of the markers clean. Whatever wiping occurs is due to the effect of high speed jets of air and, when the road is wet, water that is carried in the tread of the tire. It is estimated that the speed of this air and water stream is in the vicinity of 250 feet/second. It is the speed of the water, not the action of tires that cleans pavement markers.

The action of the tire on the face of the marker is entirely deleterious. The tire scurfs, abrades, and coats the marker shoulder with black marks. Obviously it would be desirable to provide a raised pavement marker that obtains the positive effect of the air/water stream without the negative effects of an actual tire impact on the reflective lens of the marker. As discussed more fully below, the present invention achieves this result by providing a raised pavement marker with a curved front face. The radius of curvature is only slightly less than the radius of the tire as it ramps over the marker. As a result, while the tire does not wipe the face of the marker, the air/water stream benefit is retained.

Temporary roadway markers serve to notify motorists that a construction area is near and that caution is needed. They often direct roadway traffic to pass along the portions of the roadway unaffected by construction, while protecting workers within a construction area from roadway traffic. After construction is completed, temporary roadway markers are loosened and removed. To be effective, temporary roadway markers must alert traffic to the presence of a construction area. Typically, temporary roadway markers warn oncoming motorists by the use of visual cues, such as reflective surfaces. Some temporary roadway markers also use physical cues, such as causing a vehicle to create a rumbling noise on contact with a marker.

Temporary roadway markers are designed and manufactured so as to only last a short period of time-the life of a typical construction project, for example, six months. As compared to permanent roadway markers, temporary roadway markers in general are much more simplistic in construction, less expensive to manufacture, and lower in performance standards both initially and over time. The Stimsonite Model 66 and the roadway marker described in U.S. Pat. No. 4,428,320 (Oplt et al.) are both examples of temporary roadway markers. The Stimsonite Model 66 includes an air-gap reflector angled at 45° to provide night visibility. In actual use the Stimsonite Model 66 marker provides very little initial reflectivity (66% lower than a permanent marker), which quickly fades with time. The molded lenses crack when the honeycombed body of the marker crushes under vehicle impacts. Water and dirt then get into the air-gap and eliminate reflectivity in the entire lens. The sheeting of the Oplt et al. marker is a much more efficient reflector. Being an embossed metallized polycarbonate microprism and mounted at an angle of 72°, it provides as much reflectivity as the "permanent" markers do, and for a much lower manufacturing cost. However, the reflective tape must be mounted within 20° of the vertical in order to maintain its effectiveness, due to the structure of the embossed cube-corner microprisms. The honeycombed interior of the Oplt et al. marker makes the marker lightweight, which is desirable. Although the roadway marker is lightweight, one disadvantage of an Oplt et al. type roadway marker is its high manufacturing cost. Due to its construction, an Oplt et al. type roadway marker must be injection molded. Injection molding is expensive when compared to other manufacturing processes.

Another disadvantage of Oplt et al. and Stimsonite Model 66 temporary roadway markers is the fact that they are usually molded from a low cost resin such as high impact polystyrene in such a fashion as to reduce the weight of the final part. What results is a marker with a honeycombed base pattern that is essentially hollow. Because such markers are extremely sensitive to the impact of vehicle tires they do not last long on the road, often less than 30 days. As best understood at present, the typical vertical forces exerted on a raised marker by a small passenger vehicle tire are 200 ft. lbs. Larger vehicles can increase this force to as high as 1,000 ft. lbs. In testing, neither the Stimsonite Model 66 nor the Oplt et. al. type marker was found able to withstand even 60 ft. lbs. of vertical force. Another problem that arises with the use of hollow markers is that of adhesion to the roadway. Quite often installation contractors will eschew the use of more permanent adhesives and bond the markers with an elastomeric adhesive, such as a synthetic butyl rubber pad. The effect of the hollow marker on butyl is to cut through it like a cookie cutter, placing the plastic marker in direct contact with the pavement, resulting in immediate breakage, loss of adhesion, or both.

In order to overcome the costs disadvantage associated with injection molding, roadway markers having a constant cross-sectional shape along their longitudinal axis have been developed. The constant cross-sectional shape allows such roadway markers to be made by an inexpensive extrusion manufacturing process. Such roadway markers are described in parent U.S. patent applications Ser. No. 07/735,321 and Ser. No. 07/694,873 more fully referenced above, the subject matter of which applications is incorporated herein by reference.

In addition to their constant cross-sectional shape, roadway markers of the type described in the foregoing patent applications include a base area suitable for adhesive attachment to a roadway surface, as well as a raised rumble portion. The base area of the marker is relatively large and includes a plurality of adjacent, parallel grooves of arcuate cross section. The arcuate grooves increase the adhesive surface of the marker. The longitudinal lower edges of the base curve downwardly to assist in gripping the roadway surface. The top of the raised rumble portion is scalloped to reduce the weight of the roadway marker. The longitudinal lateral sides of the raised rumble portion of the roadway marker may include a recess for receiving a strip of reflective tape. The two orthogonal sides are sheared straight, or inclined, depending upon the intended use of the marker.

While extruded roadway markers of the type described above have a number of advantages over previously developed roadway markers of the injection molded type, previously developed extruded roadway markers, like injection molded roadway markers are subject to improvement, particularly in the area of viewability over extended periods. The present invention is directed toward providing roadway markers, particularly extruded roadway markers having improved viewability over extended periods of time.

SUMMARY OF THE INVENTION

In accordance with this invention, roadway markers with large, rectangularly shaped bases and a raised rumble portion containing at least one concave curved edge are provided. The concave curved edge is intended to be the traffic facing, i.e., the leading, edge of the markers. The concavity begins at the base of the roadway marker and rises upwardly. The concavity may have a constant radius of curvature, or the radius of curvature may decrease with increased elevation. The height-to-width ratio of the roadway marker and the average radius of curvature are such that automobile tires impacting the roadway marker do not impact the surface of the concavity. Rather, tires impacting the roadway marker hit the marker above the edge concavity. As a result, a gap exists between an impacting tire and the surface of the concavity. Water squeezed from a wet tire impacting the roadway marker will enter this gap and wash the surface of the concavity.

In accordance with further aspects of this invention, a reflective tape is attached to the surface of the edge concavity, beginning slightly below the upper end of the curvature so as to lie in the gap between the concavity and an impacting tire. Because the edge is concave, the amount of light reflected by the reflective tape back toward the driver of an oncoming car is greater than the amount of light reflected from tape attached to an inclined flat edge as in the prior art. Further, because the reflective tape lies in a gap, the likelihood of the reflective tape being abraded or dislodged due to tire impact is greatly reduced. The viewability of the reflective tape is also improved by tire water washing dirt and debris from the tape.

In accordance with other aspects of this invention, the edge of the roadway marker located parallel to the edge containing the concavity contains a similar concavity. Either concave edge can form the binding edge of the roadway marker or, when used between lanes of traffic moving in opposite directions, both concave edges can face oncoming traffic. Preferably, both concave edges support a layer of reflective tape that starts below the upper end of the concavity.

In accordance with still other aspects of this invention, preferably, the roadway marker has a relatively low profile.

In accordance with still further aspects of this invention, the roadway marker has a constant cross section along its length and is created by extruding a suitable plastic material.

In accordance with yet further aspects of this invention, preferably, the upper surface of the roadway marker is scalloped whereby humps are created where the concave edges and the scallop join one another.

In accordance with yet still other aspects of this invention, the lower surface of the roadway marker includes a plurality of parallel grooves of arcuate cross section.

BRIEF DESCRIPTION OF THE DRAWINGS

The foregoing and other advantages and features of this invention will become better understood by reference to the following detailed description of preferred embodiments of the invention when taken in conjunction with the accompanying drawings, wherein.

DETAILED DESCRIPTION OF THE PREFERRED EMBODIMENTS

Figure 1:
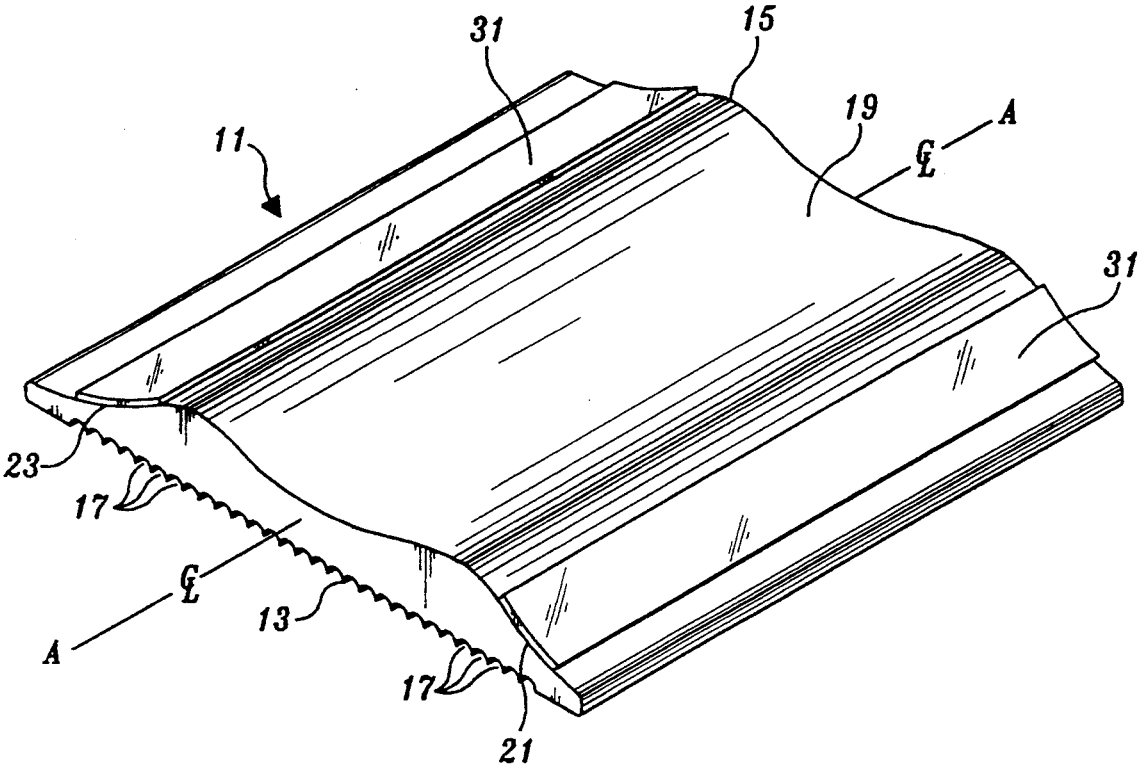
FIG. 1 is an isometric view of a roadway marker formed in accordance with this invention.
Figure 2:
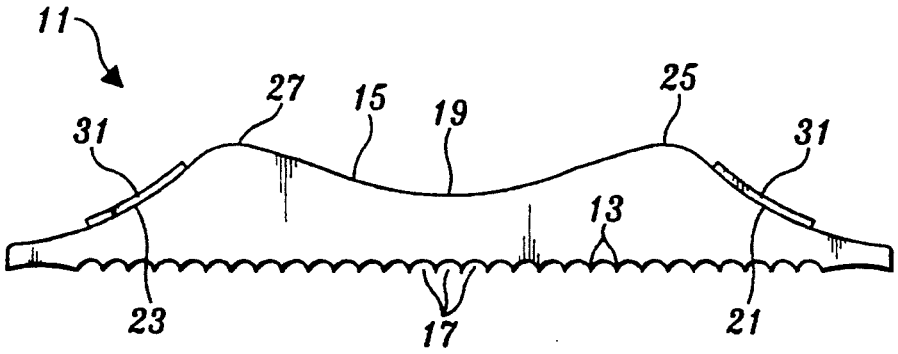
FIG. 2 is an end elevational view of the roadway marker illustrated in FIG. 1.

FIGS. 1 and 2 illustrate the general shape of a preferred embodiment of a roadway marker 11 formed in accordance with the invention. The roadway marker 11 illustrated in FIGS. 1 and 2 has a constant cross section from one end to the other along a longitudinal center line A—A. The constant cross section allows the illustrated roadway marker to be extruded using conventional nonmetallic, i.e., plastic, extrusion technology, and sheared to any desired length. The roadway marker 11 illustrated in FIG. 1 includes a base 13 and a raised rumble portion 15. The bottom of the base 13 is substantially planar and of rectangular shape. A large bottom allows a roadway marker to be strongly attached to a roadway surface by any suitable adhesive, such as epoxy, butyl, or hot melt bituminous adhesive.

The bottom of the base 13 includes a series of parallel grooves 17. The grooves 17 are disposed adjacent and parallel to one another. The grooves 17 also lie parallel to the longitudinal center line A—A. The grooves 17 extend the entire length of the marker 11 and have an arcuate cross section. When compared to a base with a flat bottom, the arcuate cross section increases the size of the adhesion surface of the bottom. The larger adhesion surface allows the base to be better attached to a roadway. Arcuate grooves have even a larger surface area than do the V-shaped grooves of some prior art roadway markers. This translates into better roadway attachment.

The raised rumble portion 15 is comprised of two regions—a center scalloped recess 19 and concave curved edges 21 and 23. Because the concave curved edges are identical, the roadway marker can be positioned such that either edge can form the traffic facing edge when the marker is used on a road with traffic moving in a single direction, or both edges can form traffic facing edges when the marker is used on a road with traffic coming from opposite directions.

The center scalloped recess and the concave curved edges cause the raised rumble portion 15 to have the cross-sectional shape of a pair of humps 25 and 27. The humps are located between the centered scalloped recess 19 and the curved edges 21 and 23. This cross-sectional shape is constant throughout the length of the roadway marker 11 along centerline A—A. Because the primary function of the scalloped recess 19 is to reduce the weight of the roadway marker, the exact shape of this recess is not critical. While shown as curved, the scalloped recess could have some other form. One important aspect of the scalloped recess 19 is its average radius of curvature. In this regard, although the exact specifications of the curvature are not critical, the average radius of curvature of the scalloped recess should be substantially less than the radius of curvature of smaller-sized automobile tires. Since smaller-sized automobile tires have a radius of curvature of thirteen (13) inches, this means that the average radius of curvature of the scalloped recess should be substantially less than thirteen (13) inches. Exemplary dimensions are included in the table set forth below. An average radius of curvature substantially less than the radius of curvature of smaller-sized automobile tires prevents automobile and other vehicle tires from seating in the recess 19 when a tire passes over the roadway marker 11.

Figure 9:
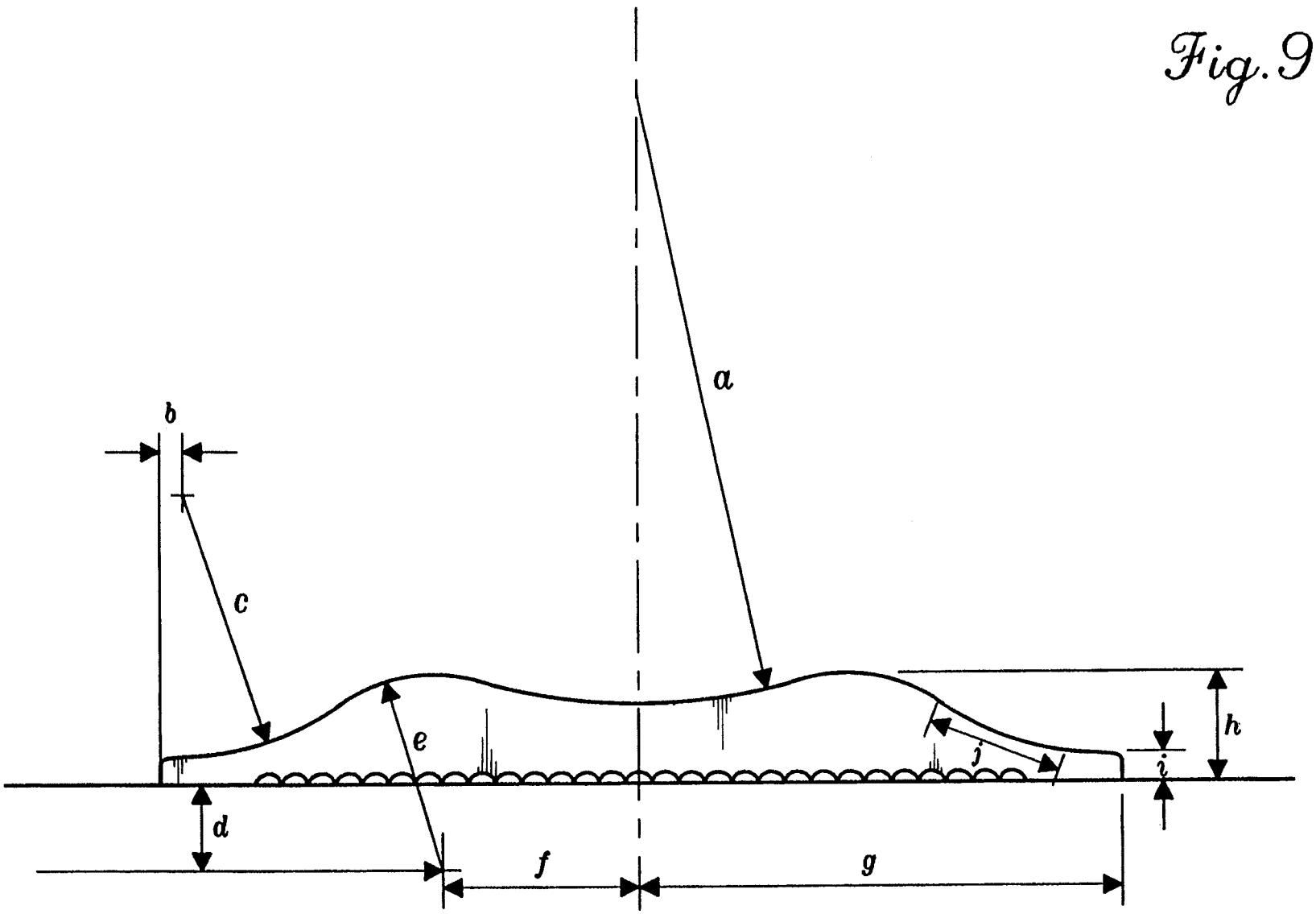
FIG. 9 is an end view of an embodiment of the invention that includes letters associated with various parameters used to create actual embodiments of the invention.

While, like ceramic roadway markers, a roadway marker formed in accordance with the present invention can be produced without any mechanism for enhancing the reflectivity of the roadway marker, preferably, as shown in FIGS. 1 and 2, a reflective medium is added to the surfaces of the concave curved edges of a roadway marker formed in accordance with the invention. More specifically, the embodiments of the invention shown in FIGS. 1 and 2 include a layer of reflective tape 31 applied to the surfaces of the concave curved edges 21 and 23. The reflective tape 31 lies atop the surface of the concave curved edges 21 and 23. The elevational location of the tape along the concave curved edges 21 and 23 is best shown in FIG. 9 and described below.

Figure 3:
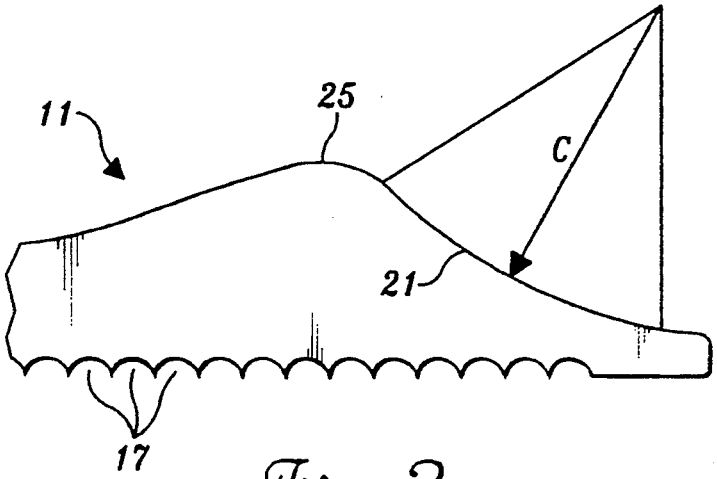
FIG. 3 is an enlarged portion of one end of FIG. 2 depicting a roadway marker wherein the radius of curvature of the concavity of the illustrated edge is constant.
Figure 4:
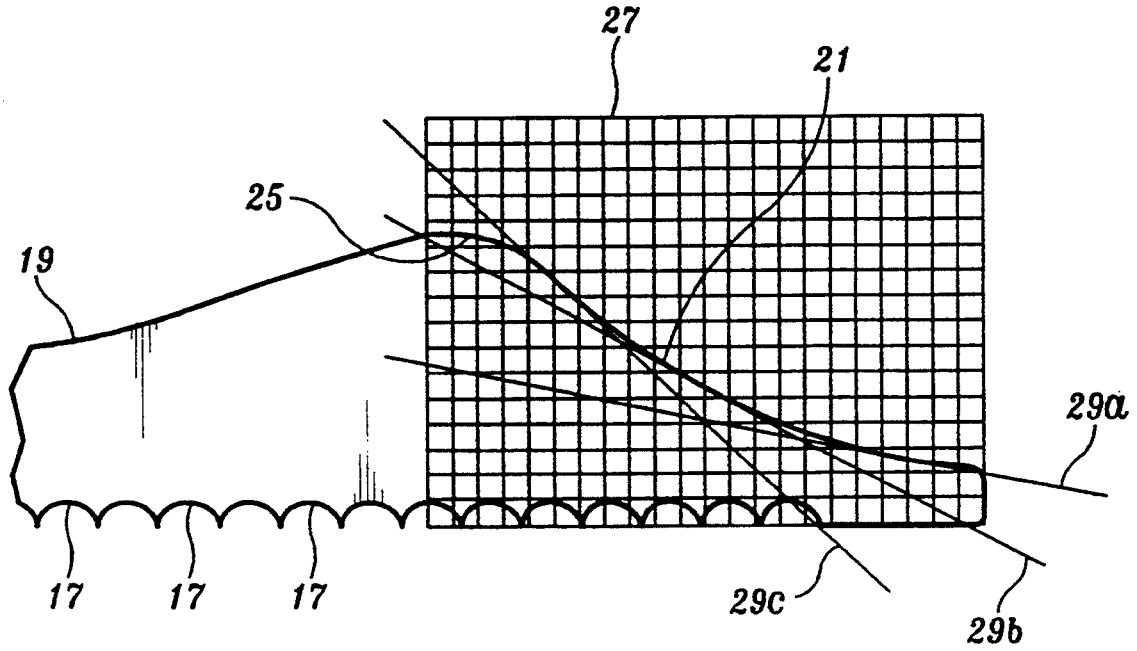
FIG. 4 is an enlarged view of one end of FIG. 2 depicting a roadway marker wherein the radius of curvature of the concavity of the illustrated edge decreases with a rise in elevation.

FIGS. 3 and 4 are enlarged views of one of the concave curved edges 21 of the embodiment of the invention illustrated in FIGS. 1 and 2, the layer of reflective tape 31 being eliminated for purposes of clarity. The curved edge shown in FIG. 3 has a constant radius of curvature (c). The center of the radius is defined in the manner shown in FIG. 9 and described below.

The radius of curvature of the concave curved edge 21 shown in FIG. 4 decreases with increased elevation. This is shown by overlaying the concave curved edge 21 with a grid 27 and a plurality of lines 29*a*, 29*b*, and 29*c* that lie tangent to the curvature of the leading edge 21. The first tangent line is located shortly after where the concave curved edge 21 begins to rise and the last is located where the edge ends. As can be seen, the rate of change of the angle of inclination of the tangent lines 29 increases as the leading edge 21 curves upwardly. This shows that the radius of curvature of the concave curved edge 21 decreases as the edge curves upwardly since the rate of change for a constant radius curve would remain constant. While the preferred curvature of the concave curved edge 21 shown in FIG. 4 is based on the tractfix or scheile curve, defined in part as "a curve such that the part of the tangent between the point of tangency and a given straight line is constant" in other words, the outside of the so-called "frictionless" curve and the involute of the "catenary" curve-other curves similar in configuration are satisfactory, such as catenary, hyperbolic, and parabolic curves. When plotted, it will be found that curves having these shapes are close to juxtaposed in the short distances plotted.

Figure 5:
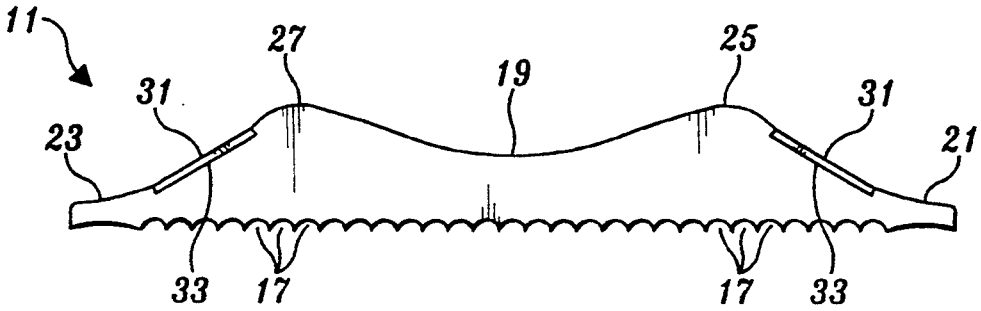
FIG. 5 is an end view illustrating another embodiment of the embodiment of the invention illustrated in FIG. 1.

FIG. 5 illustrates that the concave curved edges 21 and 23 can include an undercut region 33 for receiving the reflective tape 31. Placing the tape in an undercut provides additional protections against tire abrasion.

Figure 6:
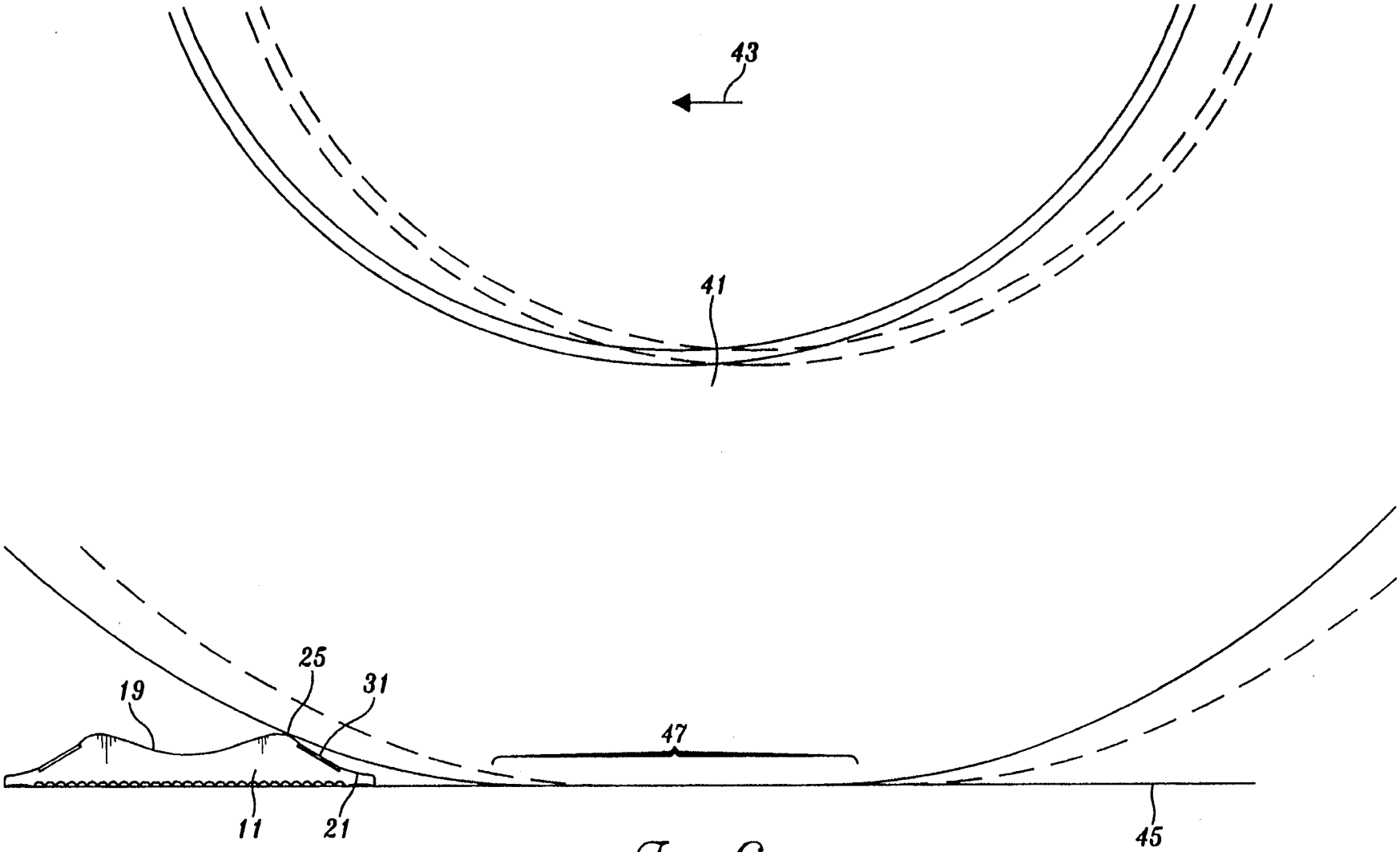
FIG. 6 is an end elevational view illustrating a dry tire impacting an embodiment of the invention of the type illustrated in FIG. 5.
Figure 7:
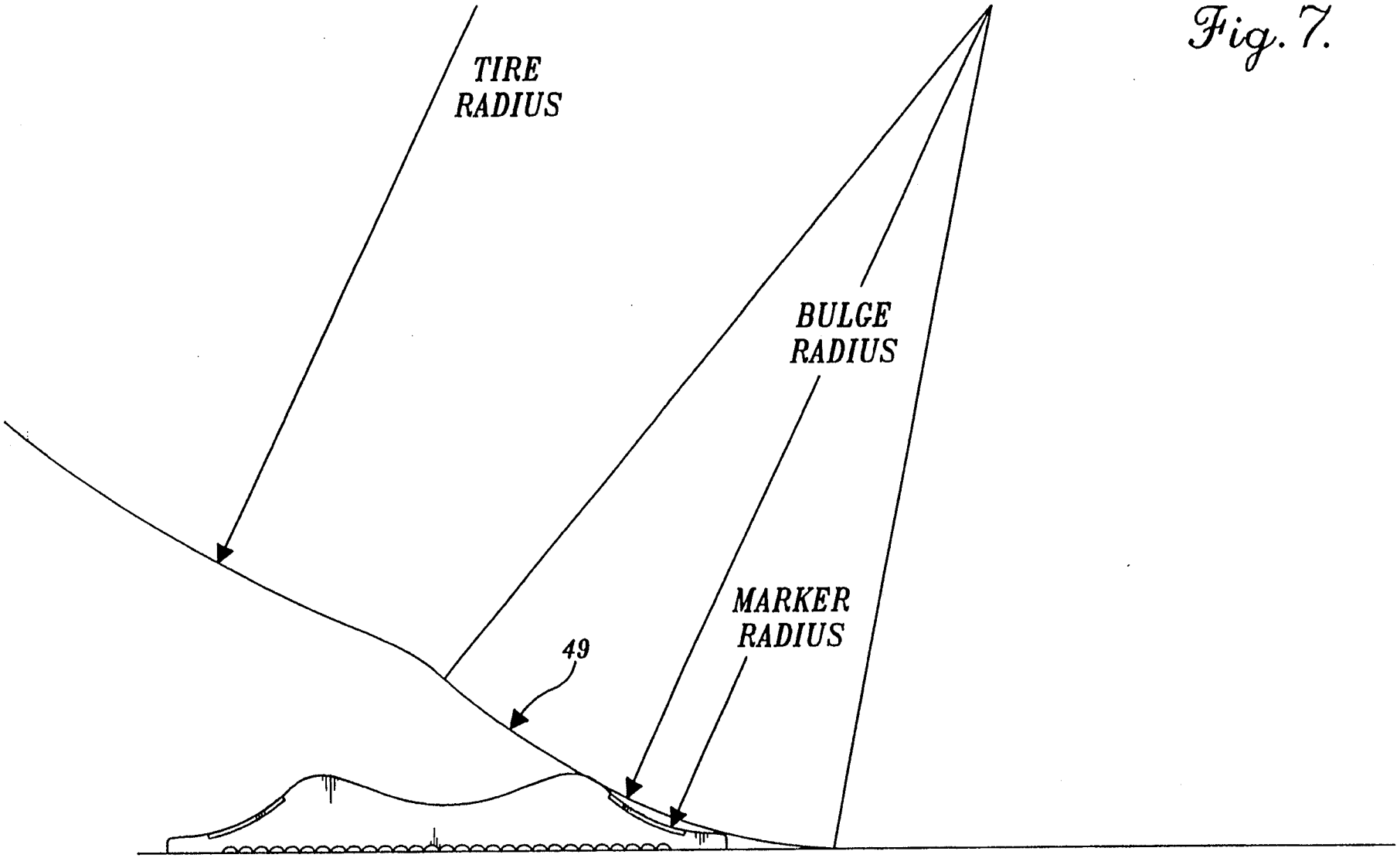
FIG. 7 is a further end elevational view illustrating a dry tire impacting an embodiment of the invention of the type illustrated in FIG. 5.

FIGS. 6 and 7 illustrate an important feature of the invention, namely, that the radius of curvature of the concave curved edges 21 and 23 of a roadway marker formed in accordance with the invention be chosen such that vehicle tires (e.g., automobile, truck, trailer) impacting the concave curved edges do not impinge on the surface of the curves. More specifically, FIG. 6 illustrates an automobile tire 41 moving in the direction of the arrow 43. Located in front of the tire 41 is a roadway marker 11 formed in accordance with the invention. The roadway marker 11 is affixed to a pavement 45 and positioned such that one of the concave curved edges 21 faces the tire 41. This is the normal positioning of a roadway marker formed in accordance with this invention.

The tire 41 includes the usual footprint region 47 where the tire is flat. The flatness is, of course, created by the weight of the automobile or other vehicle supported by the tire. By way of example, a normally inflated fifteen (15) inch radius tire has a footprint of approximately seven (7) inches. The footprint results in the tire radius at the center of the footprint being decreased by about one and one-half (1½) inches, i.e., the distance between the center of rotation of the tire and the pavement 45 on which the tire rides is approximately thirteen and one-half (13½) inches for a fifteen (15) inch radius tire.

As clearly shown in FIG. 6, the radius of curvature of the concave curved edge 21 of the roadway marker 11 is such that when the tire 41 impacts the hump 25 that occurs where the end of the concave curved edge 21 meets the recess 19, the tire 41 does not impact the surface of the concave curved edge 21. As a result, the tire 41 never rides on the surface of the concave curved edge 21 and, thus, does not impinge on the layer of reflective tape 31 located on the surface of the concave curved edge 21. In essence, the reflective tape lies in a gap between the surface of the concave curved edge and the surface of tires impacting a roadway marker formed in accordance with this invention. Consequently, most tires impacting a roadway marker formed in accordance with this invention will not apply friction to the reflective tape and, thus, will not contribute to the destruction or removal of reflective tape either located directly on the surface of the concave curved edge 21 (FIGS. 1 and 2) or located in an undercut region of the concave curved edge (FIG. 5).

FIG. 6 illustrates the "ideal" shape of a tire impacting a roadway marker formed in accordance with this invention. In actuality, radius of curvature of the leading edge of a pneumatic tire as it rolls over a pavement is not the radius of curvature of the tire as shown in FIG. 6. Rather, as shown in FIG. 7, a bulge, whose average radius of curvature is less than the radius of curvature of the tire, is usually located at the leading edge of the tire. While the average radius of curvature of the tire bulge varies depending upon the radius of the tire and the pneumatic pressure in the tire, the average radius of curvature of the tire bulge lies in the two (2) inch to five (5) inch range. In order to maintain the gap described above, obviously, the average radius of curvature of the concave curved edge should be less than the lower end of this range, i.e., less than two (2) inches.

Figure 8:
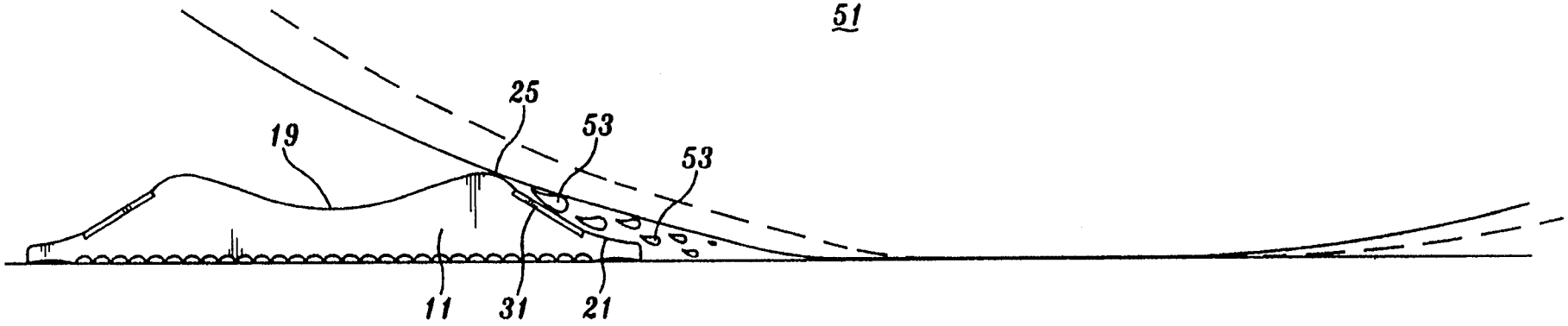
FIG. 8 is another end elevational view illustrating a wet tire impacting an embodiment of the invention of the type illustrated in FIG. 5.

FIG. 8 illustrates what occurs when a wet tire 51 passes over a roadway marker 11 formed in accordance with the invention. As the tire 51 impacts the hump 25 between the leading edge 21 and the recess 19, water droplets 53 are squeezed from the grooves in the tire 51 and wash across the surface of the concave curved edge 21. In essence, the water droplets 53 swirl around the surface of the concave curved edge 21 facing the tire. As a result, reflective tape 31 located on this surface is washed by the water droplets 53, resulting in the removal of dirt and debris.

FIG. 9 is a cross-sectional view of a roadway marker formed in accordance with this invention that includes a plurality of letters depicting various parameters of the marker. The following table lists dimensional ranges for the parameters, plus the presently preferred values used in one actual embodiment of the invention.

| Reference Letter | Dimensional Range | Preferred Value |
|---|---|---|
| a | 2–10 inches | 2.50 inches |
| b | 0–0.5 inches | 0.10 inches |
| c | 0.5–5.0 inches | 1.25 inches |
| d | 0–4.0 inches | 0.29 inches |
| e | 0.125–4.0 inches | 0.72 inches |
| f | 0–1.5 inches | 0.84 inches |
| g | 1.0–4.0 inches | 2.00 inches |
| h | 0.4–4.0 inches | 0.53 inches |
| i | 0.05–0.3 inches | 0.10 inches |
| j | 0.20–1.0 inches | 0.50 inches |

Figure 10:
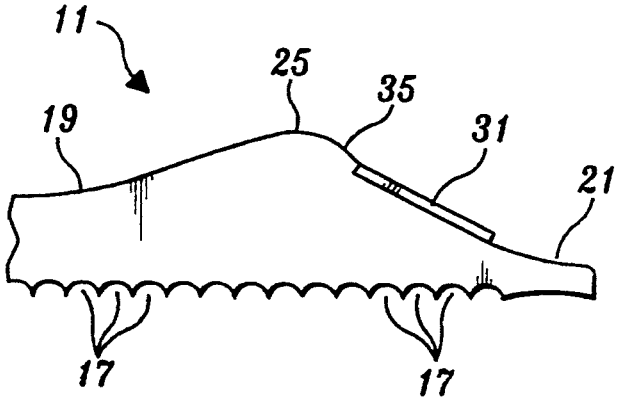
FIG. 10 is a partial end view of a still further embodiment of the invention.

FIG. 10 illustrates a concave curved edge of a further alternative embodiment of the invention. Like the embodiments of the invention illustrated in FIGS. 1 and 2, and 5, the embodiment of the invention illustrated in FIG. 10 includes reflective tape 31 located on the surface of the concave curved edges of the roadway marker 11. However, rather than lying directly on the surface, or in an undercut region of the concave curved edges, a lip 35 located just below the hump 25 that lies between the illustrated concave curved edge 21 and the recess 19 provides protection for the tape 31.

Figure 11:
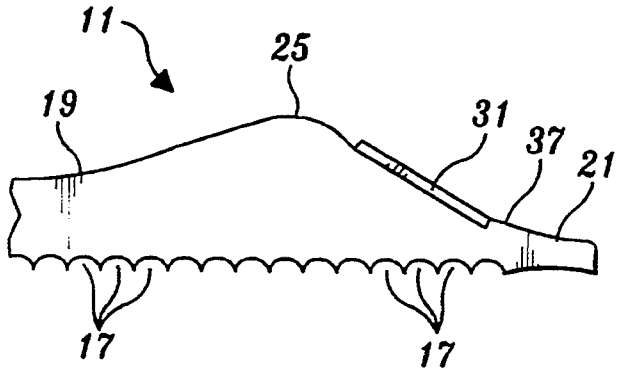
FIG. 11 is a partial end view of yet another embodiment of the invention.

FIG. 11 illustrates an embodiment of the invention that, like the embodiments of the invention illustrated in FIGS. 1 and 2, and 5, includes a reflective tape 31 located on the surface of the concave curved edges of a roadway marker 11 formed in accordance with the invention. However, rather than lying directly on the surface of the concave curved edges, or in an undercut region, the tape 31 rests against a lip 37 located at the base of the tape 31. The upper edge of the tape 31 is unprotected.

Figure 12:
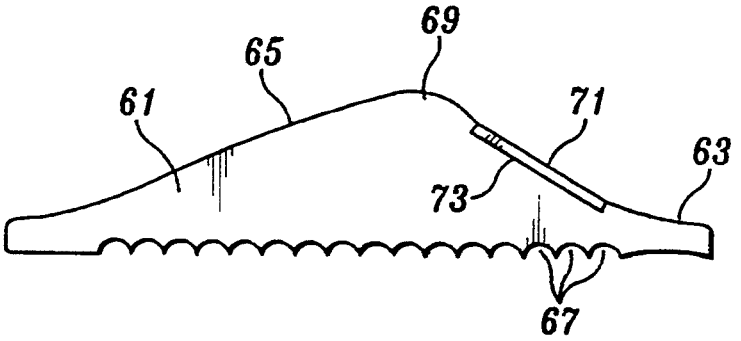
FIG. 12 is an end view of still another embodiment of the invention.

In all of the previously described embodiments of the invention, both edges, i.e., the leading and trailing edges, of roadway markers formed in accordance with the invention have been identically shaped regardless of whether they support, or do not support, reflective tape. Thus, these embodiments of the invention are symmetrical whereby either edge can form the traffic facing edge when a roadway marker formed in accordance with the invention is mounted on a roadway surface having traffic moving in one direction, or both edges can form traffic facing edges when a roadway marker formed in accordance with this invention is mounted on a roadway surface having traffic moving in opposite directions. In contrast, FIG. 12 illustrates a unidirectional embodiment of the invention. More specifically, the roadway marker 61 illustrated in FIG. 12 includes a leading edge 63 and a sloping, trailing edge 65. The leading edge has a convex curved shape of the type previously described. The base includes a plurality of parallel arcuate grooves 67. Rather than including a recess, after the point where the concave curved edge 63 reaches a hump 69, the hump tapers to the trailing edge of the roadway marker 61. Preferably, located on the surface of the concave curved leading edge 63 is a reflective tape 71. As with the previously described embodiments of the invention, the reflective tape 71 can be located in an undercut region 73, as shown, or directly on the surface of the concave curved edge 63 (FIGS. 1 and 2) or protected by upper or lower lips (FIGS. 10 and 11).

Figure 13:
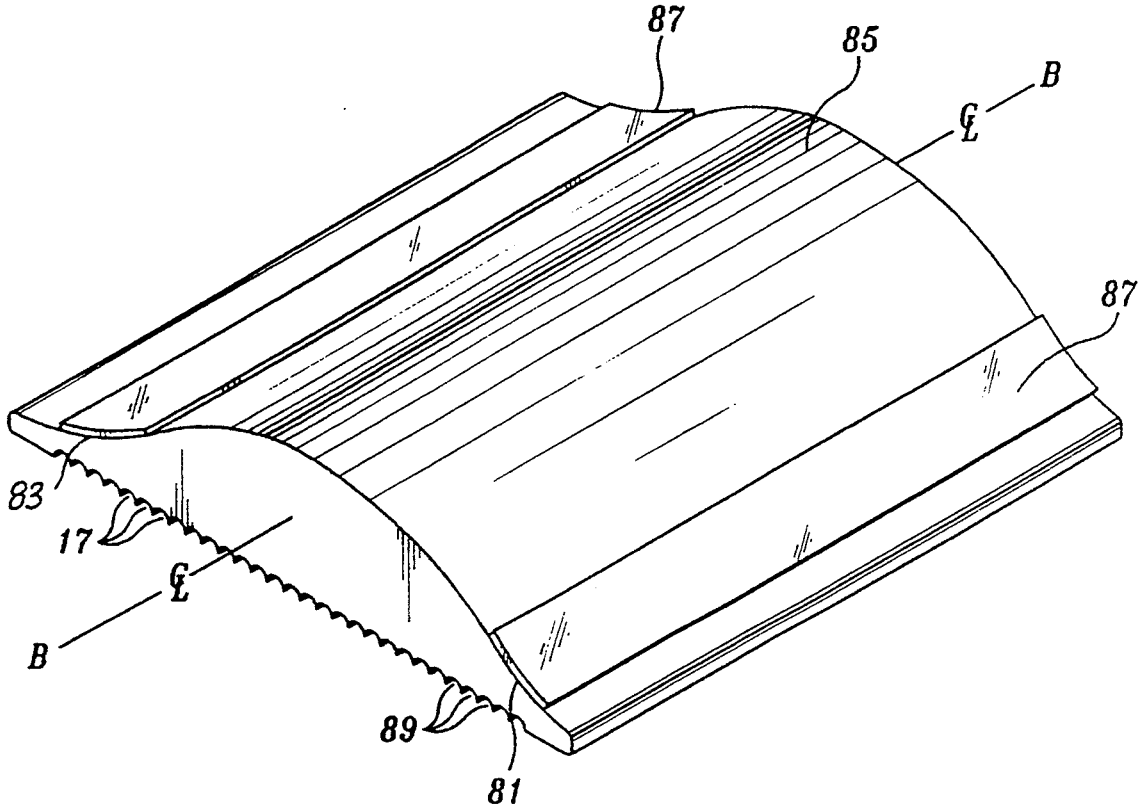
FIG. 13 is an isometric view of yet another embodiment of the invention.

FIG. 13 illustrates yet another embodiment of the invention. Rather than the raised rumble portion including a scalloped recess located between concave curved edges 81 and 83, a convex protrusion 85 is located therebetween. As with the other embodiments of the invention, the cross-sectional shape of the roadway marker is constant along its longitudinal axis B—B and the concave curved edges 81 and 83 have a constant or variable radius of curvature sized such that tires hitting the concave curved edges do not apply friction to strips of reflective tape 87 applied to the concave curved edges. The convex protrusion 85 rises upwardly between the concave curved edges 81 and 83. The radius of curvature of the convex protrusion lies in the 2–10 inch range, with 3.375 inches being preferred. The base of the marker illustrated in FIG. 13 is the same as the base of the previously described markers, i.e., the base includes a plurality of parallel grooves 89.

As illustrated in the drawings, preferably, roadway markers formed in accordance with the invention have a constant cross section. This allows such embodiments of the invention to be manufactured by extrusion. That is, the illustrated embodiments of the invention all can be formed by extruding a suitable plastic through a dye having a shape corresponding to the desired cross-sectional configuration. The extrudate is then cured and hardened. The manufacture of roadway markers using an extrusion method greatly decreases the cost of such markers. Moreover, extrusion allows roadway markers performed in accordance with the present invention to be easily manufactured in varying length. This allows the embodiments of the invention to be used as "rumble" strips, as well as spaced-apart roadway markers. The continuous nature of the base allows less adhesive to be used to create a strong bond between the base of the roadway marker and a road surface when compared to bases that are interrupted by hollow regions such as that described in the Oplt et al. patent referenced above. Adhesive tends to ooze into the hollows of Oplt et al. type bases, reducing adhesive effectiveness. On the other hand, while, preferably, the embodiments of the invention are made by extrusion, embodiments of the invention could be molded, if desired. That is, molded roadway markers including concave curved edges can be formed in accordance with the invention even though, at present, such roadway markers appear to be less desirable because they are less economical to manufacture than extruded roadway markers. Further, damaged and/or eroded reflective tape can be replaced, provided the bodies of markers formed in accordance with the invention remain intact, making embodiments of the invention reusable and, thus, still more economical.

While preferred embodiments of the invention have been illustrated and described, it will be appreciated that, within the scope of the appended claims, various changes can be made therein without departing from the spirit and scope of the invention. Thus, it is to be understood that, within the scope of the appended claims, the invention can be practiced otherwise than as specifically described herein.

The embodiments of the invention in which an exclusive property or privilege is claimed are defined as follows:

1. A roadway marker having a base for attachment to a roadway surface and a raised rumble portion, said base having a substantially rectangular shape, said raised rumble portion projecting upwardly from said base, said raised rumble portion defined in part by at least one edge, said at least one edge including a concave curved surface that extends upwardly from said base a substantial distance toward the top of said raised rumble portion, said roadway marker further including a layer of reflective material positioned on said concave curved surface.

2. A roadway marker as claimed in claim 1, wherein said concave curved surface includes an undercut region and wherein said layer of reflective material lies in said undercut region.

3. A roadway marker as claimed in claim 1, wherein said concave curved surface includes a lip lying along the upper edge of said layer of reflective material.

4. A roadway marker as claimed in claim 1, wherein said concave curved surface includes a lip lying along the lower edge of said layer of reflective material.

5. A roadway marker as claimed in claim 1, wherein said raised rumble portion includes a second edge lying parallel to said first edge, said second edge also including a concave curved surface that extends upwardly from said base a substantial distance toward the top of said raised rumble portion, said roadway marker further including a layer of reflective material positioned on said concave curved surface of said second edge.

6. A roadway marker as claimed in claim 5, wherein said concave curved surfaces include an undercut region and wherein said layers of reflective material lie in said undercut regions.

7. A roadway marker as claimed in claim 5, wherein said concave curved surfaces include lips lying along the upper edge of said layers of reflective material.

8. A roadway marker as claimed in claim 5, wherein said concave curved surfaces include lips lying along the lower edge of said layers of reflective material.

9. A roadway marker as claimed in claim 5 including a recess located in said raised rumble portion between said edges containing said concave curved surfaces.

10. A roadway marker as claimed in claim 9, wherein said concave curved surfaces include an undercut region and wherein said layers of reflective material lie in said undercut regions.

11. A roadway marker as claimed in claim 9, wherein said concave curved surfaces include lips lying along the upper edge of said layers of reflective material.

12. A roadway marker as claimed in claim 9, wherein said concave curved surfaces include lips lying along the lower edge of said layers of reflective material.

13. A roadway marker as claimed in claim 5 including a protrusion located in said raised rumble portion between said edges containing said concave curved surfaces.

14. A roadway marker as claimed in claim 1, wherein said roadway marker is extruded from a nonmetallic material.

15. A roadway marker as claimed in claim 14, wherein said concave curved surface includes an undercut region and wherein said layer of reflective material lies in said undercut region.

16. A roadway marker as claimed in claim 14, wherein said concave curved surface includes a lip lying along the upper edge of said layer of reflective material.

17. A roadway marker as claimed in claim 14, wherein said concave curved surface includes a lip lying along the lower edge of said layer of reflective material.

18. A roadway marker as claimed in claim 14, wherein said raised rumble portion includes a second edge lying parallel to said first edge, said second edge also including a concave curved surface that extends upwardly from said base a substantial distance toward the top of said raised rumble portion, said roadway marker further including a layer of reflective material positioned on said concave curved surface of said second edge.

19. A roadway marker as claimed in claim 18, wherein said concave curved surfaces include an undercut region and wherein said layers of reflective material lie in said undercut regions.

20. A roadway marker as claimed in claim 18, wherein said concave curved surfaces include lips lying along the upper edge of said layers of reflective material.

21. A roadway marker as claimed in claim 18, wherein said concave curved surfaces include lips lying along the lower edge of said layers of reflective material.

22. A roadway marker as claimed in claim 18, including a recess located in said raised rumble portion between said first and second edges containing said concave curved surfaces.

23. A roadway marker as claimed in claim 22, wherein said concave curved surfaces include an undercut region and wherein said layers of reflective material lie in said undercut regions.

24. A roadway marker as claimed in claim 22, wherein said concave curved surfaces include lips lying along the upper edge of said layers of reflective material.

25. A roadway marker as claimed in claim 22, wherein said concave curved surfaces include lips lying along the lower edge of said layers of reflective material.

26. A roadway marker as claimed in claim 18, including a protrusion located in said raised rumble portion between said edges containing said concave curved surfaces.

* * * * *

UNITED STATES PATENT AND TRADEMARK OFFICE

CERTIFICATE OF CORRECTION

PATENT NO. : 5,392,728

DATED : February 28, 1995

INVENTOR(S) : P.A. Speer et al.

It is certified that error appears in the above-indentified patent and that said Letters Patent is hereby corrected as shown below:

| COLUMN | LINE | |
|---|---|---|
| 3 | 8 | "scurfs," should read --scuffs,-- |
| 7 | 62 | "tractfix" should read --tractrix-- |

Signed and Sealed this

Twenty-third Day of May, 1995

Bruce Lehman

*Attest:*

BRUCE LEHMAN

*Attesting Officer*

*Commissioner of Patents and Trademarks*